US010770834B2

(12) United States Patent
Tanaka et al.

(10) Patent No.: US 10,770,834 B2
(45) Date of Patent: Sep. 8, 2020

(54) FITTING CONNECTOR

(71) Applicant: Yazaki Corporation, Tokyo (JP)

(72) Inventors: Yasuhiro Tanaka, Shizuoka (JP); Noboru Hayasaka, Shizuoka (JP); Shotaro Shibata, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/588,660

(22) Filed: Sep. 30, 2019

(65) Prior Publication Data

US 2020/0136307 A1 Apr. 30, 2020

(30) Foreign Application Priority Data

Oct. 26, 2018 (JP) ..... 2018-201620

(51) Int. Cl.
*H01R 13/627* (2006.01)
*H01R 13/635* (2006.01)
*H01R 13/641* (2006.01)

(52) U.S. Cl.
CPC ..... *H01R 13/6272* (2013.01); *H01R 13/635* (2013.01); *H01R 13/641* (2013.01)

(58) Field of Classification Search
CPC . H01R 13/641; H01R 13/6272; H01R 13/635
See application file for complete search history.

(56) References Cited

U.S. PATENT DOCUMENTS 6,902,420 B2 * 6/2005 Muro ..... H01R 13/6272 439/358
9,203,190 B2 * 12/2015 Hamai ..... H01R 13/639
9,583,876 B2 * 2/2017 Sekino ..... H01R 13/62933
10,069,241 B2 9/2018 Hayasaka

FOREIGN PATENT DOCUMENTS

JP 5729248 B2 6/2015
JP 2017-212196 A 11/2017

* cited by examiner

*Primary Examiner* — Briggitte R. Hammond
(74) *Attorney, Agent, or Firm* — Kenealy Vaidya LLP

(57) ABSTRACT

In a fitting connector, a latch hold body includes a first fulcrum portion provided on a latch-release arm portion and exerting force in a detaching direction from a second latch hold portion on a first latch hold portion with a contact point with a first release-operation force receiving portion as a fulcrum when a latch-release operation portion is pushed, and a second fulcrum portion provided on the latch-release operation portion side relative to the first fulcrum portion in the latch-release arm portion and exerting the force in the detaching direction from the second latch hold portion on the first latch hold portion with a contact point with a second release-operation force receiving portion that contacted along with continuation of push operation as a new fulcrum.

20 Claims, 9 Drawing Sheets

FITTING CONNECTOR

CROSS-REFERENCE TO RELATED APPLICATION(S)

The present application claims priority to and incorporates by reference the entire contents of Japanese Patent Application No. 2018-201620 filed in Japan on Oct. 26, 2018.

BACKGROUND OF THE INVENTION

1. Field of the Invention

The present invention relates to a fitting connector.

2. Description of the Related Art

Conventionally, known has been a fitting connector that includes two connectors fitted into each other such as a female connector and a male connector and, by providing a complete fitting state between the connectors, makes terminals of both connectors electrically connect with each other. In this fitting connector, in order to maintain the fitting state between the respective connectors in a complete fitting state as is, a holding structure is provided between the housings of the respective connectors. The holding structure includes a first latch hold portion provided on one housing and a second latch hold portion provided on the other housing and, by causing the first latch hold portion and the second latch hold portion to latch in a connector removal direction at the time of a complete fitting state, maintains the connectors in the complete fitting state as is.

In this holding structure, one of the first latch hold portion and the second latch hold portion is formed as a hole portion or a groove portion, and the other one is formed as a protrusion portion that is inserted to the hole portion or the groove portion. This holding structure is also provided with a latch release function for canceling the latched state between the first latch hold portion and the second latch hold portion. The latch release function is a function of detaching the first latch hold portion and the second latch hold portion from each other in a latched state in accordance with the predetermined latch release operation. For example, the holding structure includes a latch hold body on which the first latch hold portion is provided, and the latch hold body has the latch release function. The latch hold body includes a first latch hold portion provided on one end, a latch-release operation portion provided on the other end, a cantilever latch arm portion on which the first latch hold portion is provided at a free end and arranged between the first latch hold portion and the latch-release operation portion, and a fulcrum portion that causes the latch arm portion to elastically deform and causes the first latch hold portion as the point of action to detach from a second latch hold portion when the latch-release operation portion as the point of effort is pushed in a latched state. The fitting connector including such a holding structure is disclosed in Japanese Patent No. 5729248, for example.

Incidentally, in such a holding structure, in order to detach the first latch hold portion and the second latch hold portion from each other in a latched state, a lever ratio between a portion between the fulcrum in the latch hold body and the point of effort and a portion between the fulcrum and the point of action, and the push operation amount of the latch-release operation portion are set. In this holding structure, the lever ratio and the push operation amount are determined in accordance with a latching margin, static frictional force, or the like between the first latch hold portion and the second latch hold portion in a latched state, for example. In the conventional holding structure, because the lever ratio is set at a single fulcrum, depending on the magnitude of the latching margin, the static frictional force, or the like, the latch hold body may become large and the push operation amount may become large, and thus it is difficult to reduce the push operation force of the latch-release operation portion while preventing the physical size of the fitting connector from increasing in size.

SUMMARY OF THE INVENTION

An object of the present invention is to provide a fitting connector that makes it possible to improve usability in latch release operation of the holding structure.

In order to achieve the above mentioned object, a fitting connector according to one aspect of the present invention includes a first connector that includes a terminal and a housing holding the terminal; a second connector that includes a counterpart terminal and a counterpart housing holding the counterpart terminal, and is configured to electrically connect the terminal with the counterpart terminal when a fitting state between the housing and the counter housing along with insertion and fitting between the housing and the counter housing is in a complete fitting state; and a holding structure that includes a first latch hold portion provided on the housing and a second latch hold portion provided on the counterpart housing, is configured to cause the first latch hold portion and the second latch hold portion to be in a state capable of latching in a connector removal direction when the fitting state is in the complete fitting state, and maintains the fitting state in the complete fitting state as is, wherein the holding structure includes a latch hold body on which the first latch hold portion is provided, and the latch hold body includes the first latch hold portion provided on one end in a connector insertion-removal direction, a latch-release operation portion provided on the other end in the connector insertion-removal direction, a cantilever latch arm portion on which the first latch hold portion is provided at a free end and arranged between the first latch hold portion and the latch-release operation portion, a latch-release arm portion coupling the first latch hold portion and the latch-release operation portion, a first fulcrum portion provided on the latch-release arm portion and configured to exert force in a detaching direction from the second latch hold portion on the first latch hold portion as a point of action with a contact point with a first release-operation force receiving portion as a fulcrum when the latch-release operation portion as a point of effort is pushed in a state where the first latch hold portion and the second latch hold portion are able to latch, and a second fulcrum portion provided on the latch-release operation portion side relative to the first fulcrum portion in the latch-release arm portion and configured to contact with a second release-operation force receiving portion on the latch-release operation portion side relative to the first release-operation force receiving portion along with continuation of the push operation and exert the force in the detaching direction from the second latch hold portion on the first latch hold portion as a point of action with a contact point with the second release-operation force receiving portion as a new fulcrum.

According to another aspect of the present invention, in the fitting connector, it is desirable to further include an elastic member configured to exert resilient force in the connector removal direction on each of the first connector and the second connector when the fitting state is in the complete fitting state, wherein the holding structure causes the first latch hold portion and the second latch hold portion to be in a latched state in the connector removal direction by the resilient force of the elastic member when the fitting state is in the complete fitting state, and maintains the fitting state in the complete fitting state as is.

According to still another aspect of the present invention, in the fitting connector, it is desirable to configure that a first fulcrum by the contact point between the first fulcrum portion and the first release-operation force receiving portion is, as viewed in a push operation direction for the latch-release operation portion, provided on a near side relative to a second fulcrum by the contact point between the second fulcrum portion and the second release-operation force receiving portion.

According to still another aspect of the present invention, in the fitting connector, it is desirable to configure that the first release-operation force receiving portion and the second release-operation force receiving portion are provided on the housing or the counterpart housing.

According to still another aspect of the present invention, in the fitting connector, it is desirable to configure that the housing includes a tubular housing having the connector insertion-removal direction as a tube axial direction, and the latch hold body that is configured to connect a fixed end of the latch arm portion to an external wall surface of the tubular housing and make at least the first latch hold portion be opposingly arranged to a through-hole provided on the outer wall surface of the tubular housing, and the counterpart housing includes a counterpart tubular housing having the connector insertion-removal direction as a tube axial direction and configured to be inserted to and fitted in an internal space of the tubular housing, and the second latch hold portion projecting from an outer wall surface of the counterpart tubular housing.

According to still another aspect of the present invention, in the fitting connector, it is desirable to configure that the through-hole of the tubular housing is formed to be opposingly arranged to the first fulcrum portion also, and the holding structure uses an opposing wall surface to the first fulcrum portion via the through-hole in the outer wall surface of the counterpart housing as the first release-operation force receiving portion, and uses a peripheral edge portion of an opening on a connector insertion direction side in an opposing wall surface to the second fulcrum portion in the outer wall surface of the tubular housing as the second release-operation force receiving portion.

According to still another aspect of the present invention, in the fitting connector, it is desirable to configure that one of the first latch hold portion and the second latch hold portion is formed as a hole portion or a groove portion, and the other one is formed as a protrusion portion to insert to the hole portion or the groove portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

The following describes an exemplary embodiment of a fitting connector according to the present invention in detail based on the accompanying drawings. The invention, however, is not intended to be limited by the embodiment.

Embodiment

In a fitting connector, provided are two connectors (a first connector and a second connector) to be fitted to each other along with insertion operation between the two. In this fitting connector, terminals of both connectors are fitted in along with the insertion and fitting operation, and the terminals are physically and electrically connected. Meanwhile, in this fitting connector, the respective connectors are pulled away along with removal operation between the two and, along with this, the physical and electrical connection of the terminals of both is canceled. The insertion direction and the removal direction are in reverse directions to each other. In the following description, the insertion direction (a fitting direction) of the self to the counterpart is referred to as "connector insertion direction", and the removal direction of the self from the counterpart is referred to as "connector removal direction". When the direction out of these directions is not specified, it is referred to as "connector insertion-removal direction". Moreover, an orthogonal direction with respect to the connector insertion-removal direction is referred to as "first orthogonal direction", and the orthogonal direction with respect to the connector insertion-removal direction and the first orthogonal direction is referred to as "second orthogonal direction".

The fitting state of each connector is broadly divided into a complete fitting state and a half-fitting state. The complete fitting state means a state where housings of the respective connectors have been finished inserting to each other up to a position as designed, and where the physical and electrical connection of the terminals of both connectors has been established. The half-fitting state means a state where the housings of the respective connectors are fitted to each other except for the complete fitting state. For example, if it is in the middle of insertion and fitting operation of the respective connectors, a fitting state before reaching a complete fitting state is referred to as a half-fitting state, and if it is in the middle of removal operation of the respective connectors, a fitting state after releasing the complete fitting state is referred to as a half-fitting state.

The following describes the fitting connector of the present embodiment with reference to FIG. 1 to FIG. 9.

Figure 1:
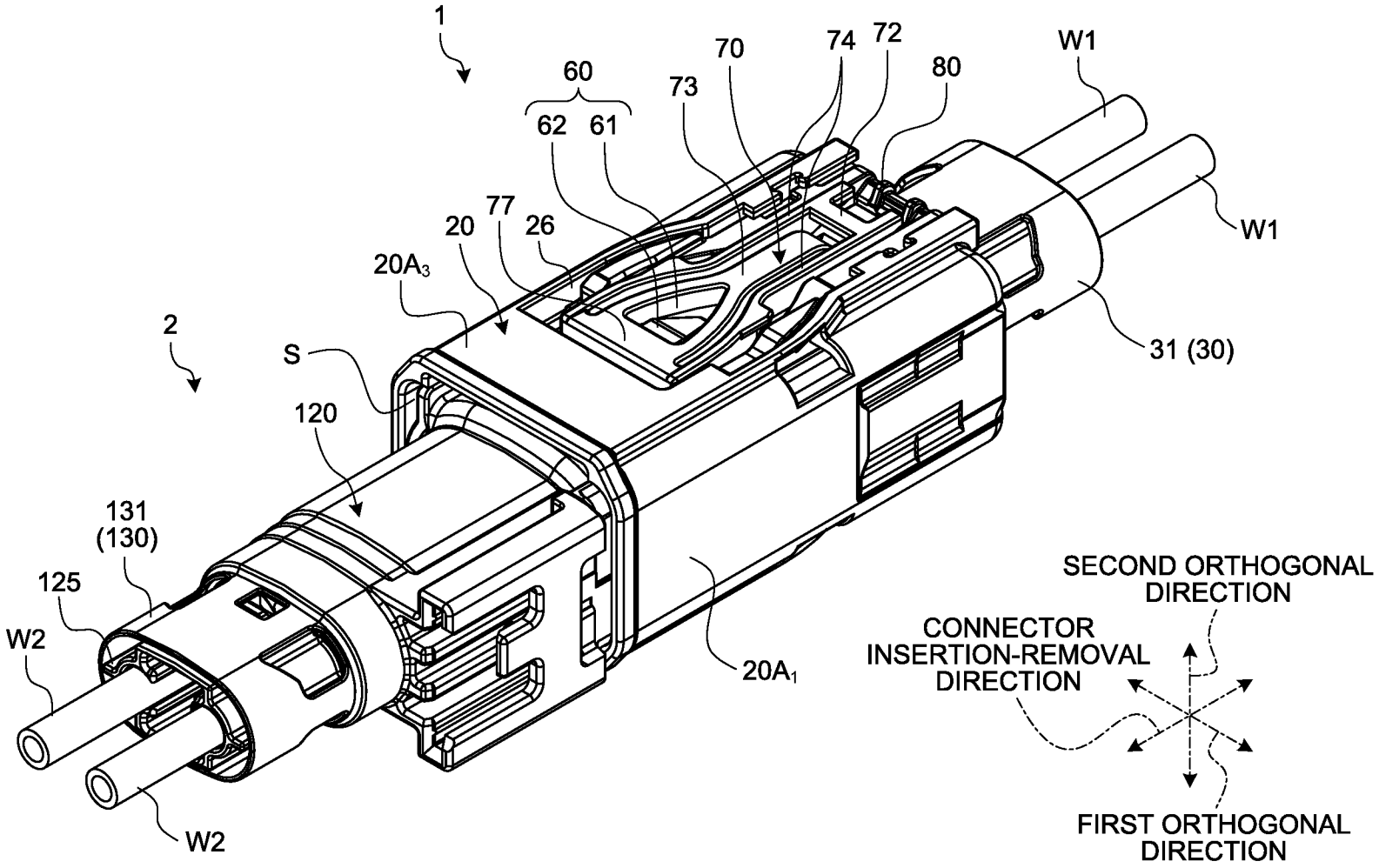
FIG. 1 is a perspective view illustrating a situation at the time a first connector and a second connector according to an embodiment are in a complete fitting state.
Figure 2:
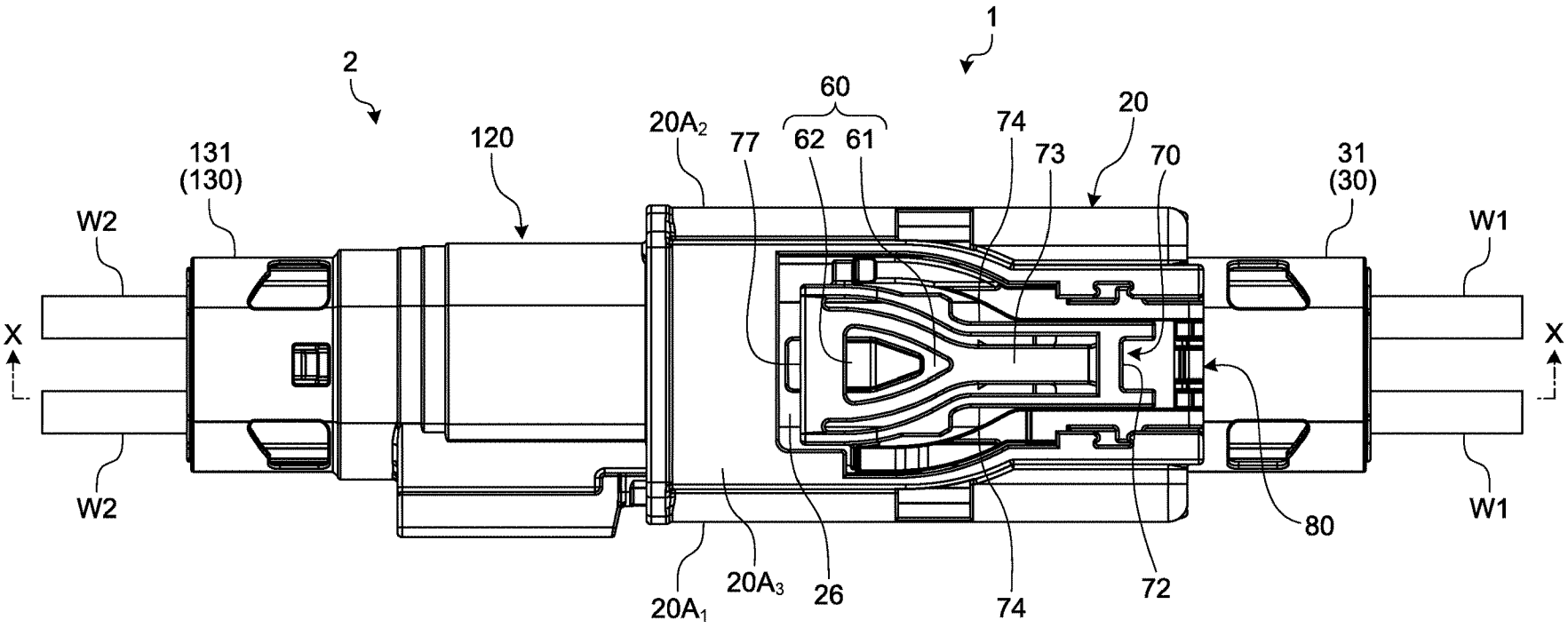
FIG. 2 is a plan view illustrating a situation at the time the first connector and the second connector of the embodiment are in the complete fitting state.
Figure 3:
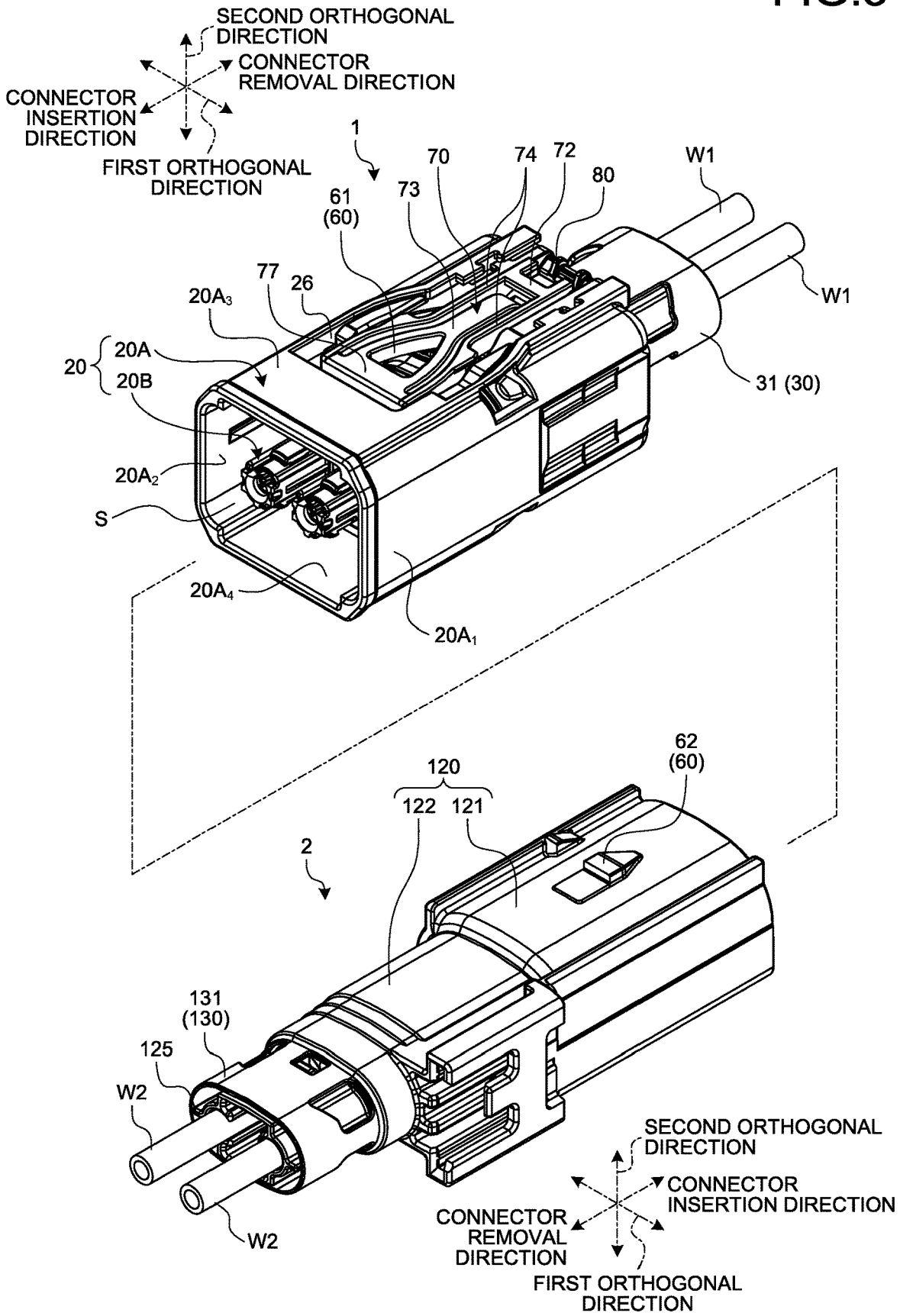
FIG. 3 is a perspective view illustrating a situation before fitting in the first connector and the second connector of the embodiment.

The reference signs 1 and 2 in FIG. 1 to FIG. 3 represent a first connector and a second connector, respectively, that the fitting connector of the present embodiment is provided with. The fitting connector of the present embodiment is a female-male connector having a female connector and a male connector, and the first connector 1 is described as the female connector and the second connector 2 is described as the male connector.

Figure 4:
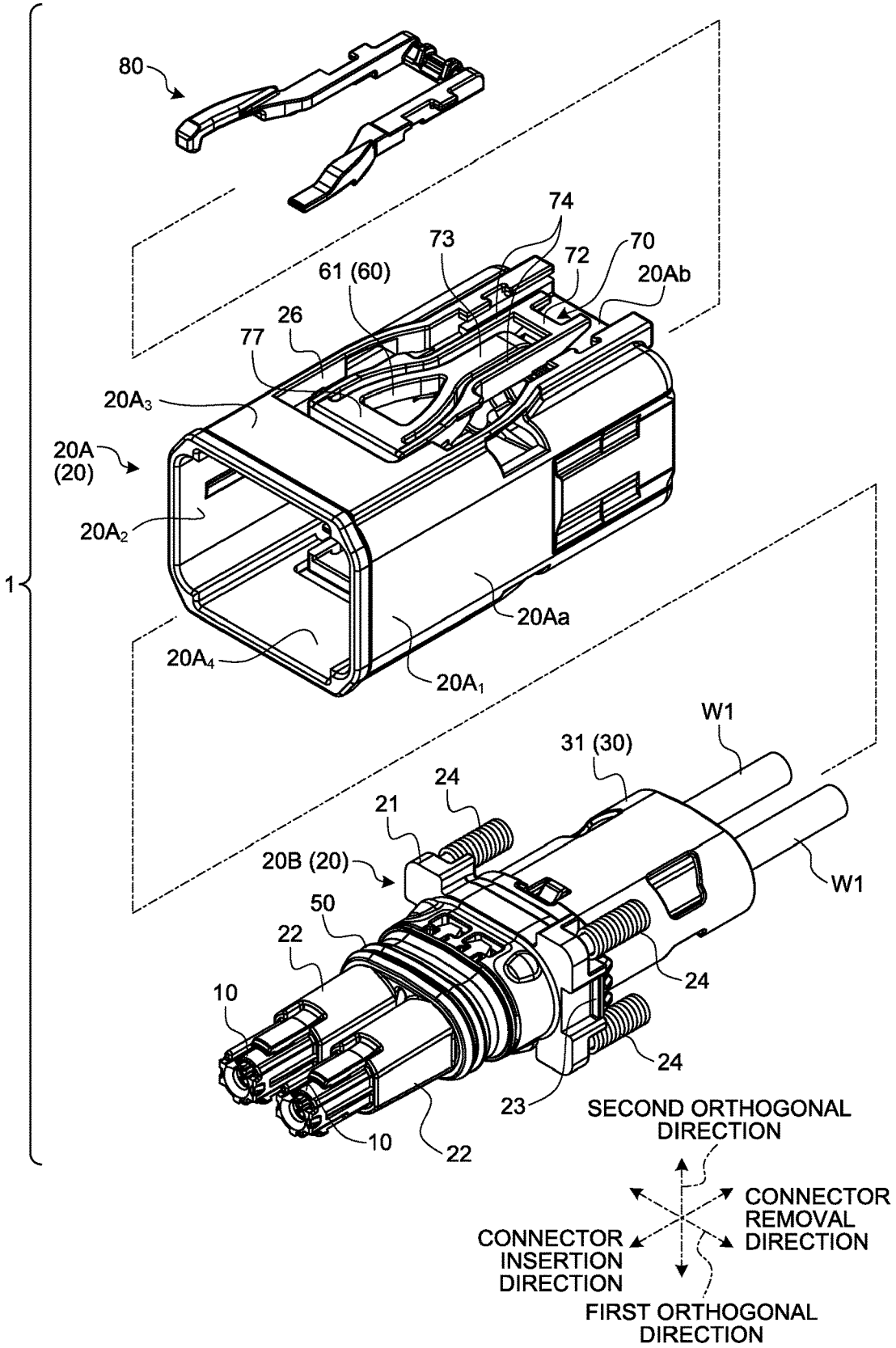
FIG. 4 is an exploded perspective view of the first connector.
Figure 5:
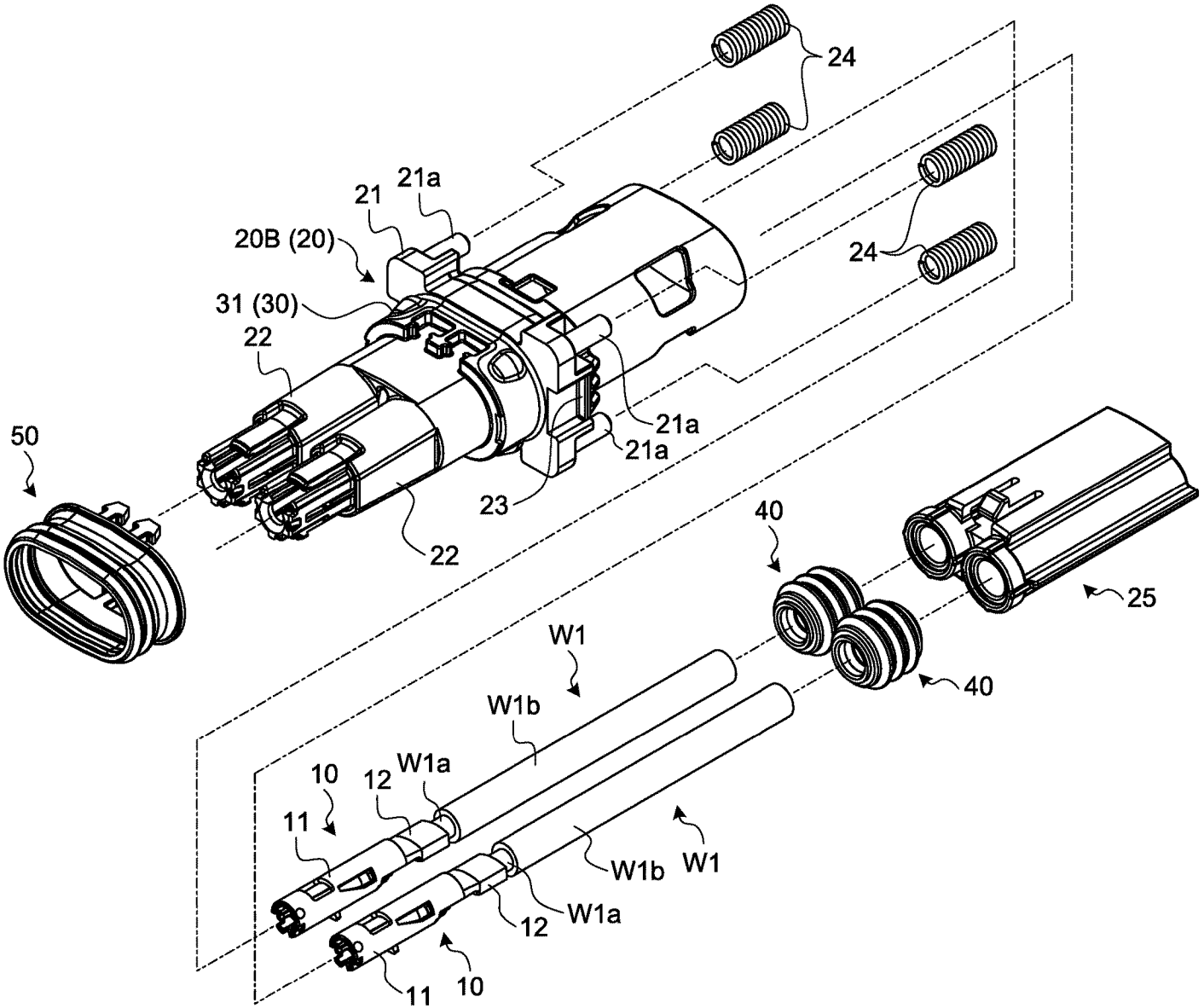
FIG. 5 is an exploded perspective view of internal components of the first connector.
Figure 6:
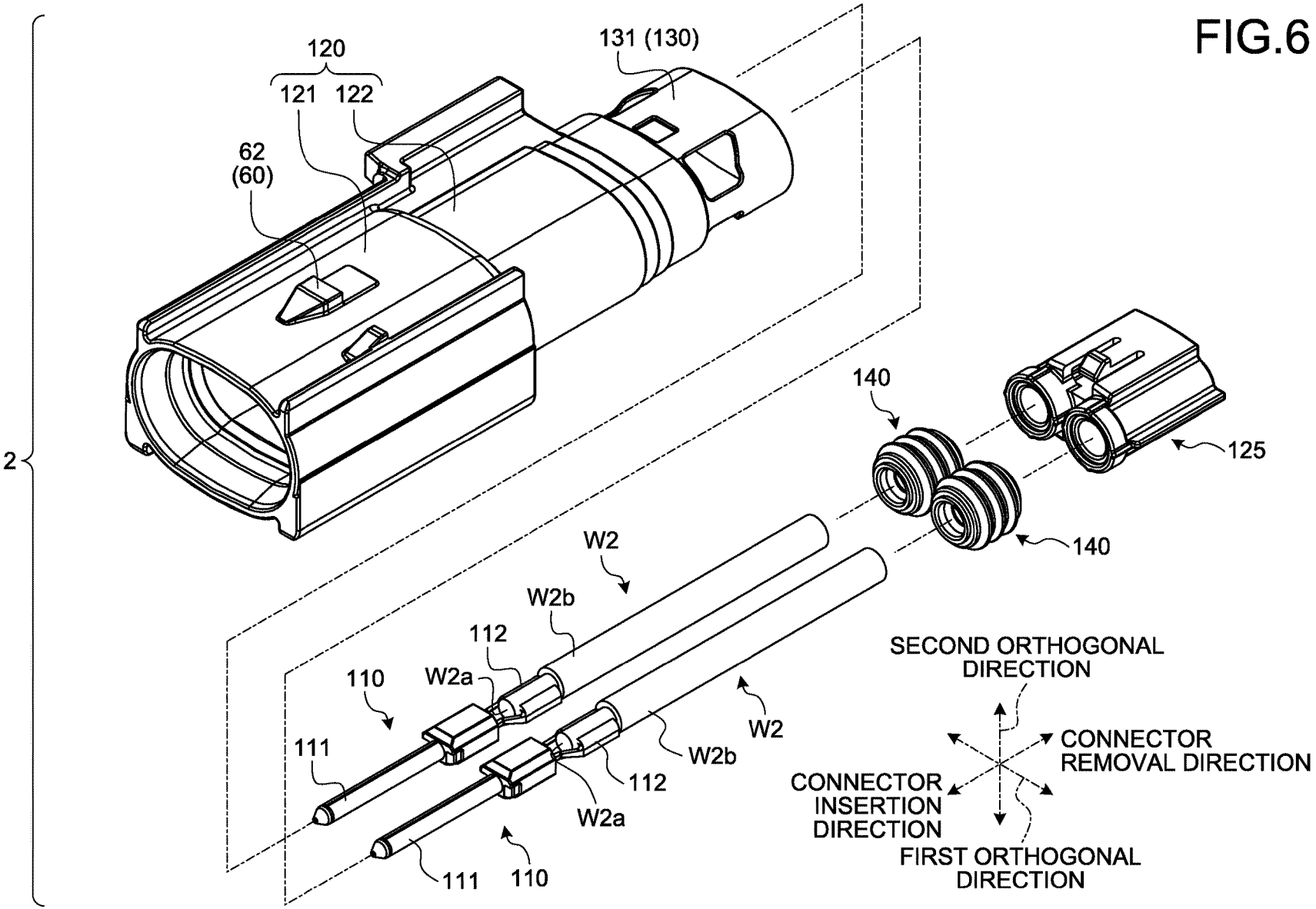
FIG. 6 is an exploded perspective view of the second connector.

The first connector 1 includes terminals (hereinafter referred to as "female terminals") 10, and a housing (hereinafter referred to as "female housing") 20 that holds the female terminals 10 (FIG. 4 and FIG. 5). The first connector 1 further includes a shield structure 30 (FIG. 1 to FIG. 5) that prevents infiltration of external noise, and a seal member 40 (FIG. 5) that prevents infiltration of liquid from the outside. The second connector 2 is a counterpart connector fitted into the first connector 1, and includes counterpart terminals (hereinafter referred to as "male terminals") 110, a counterpart housing (hereinafter referred to as "male housing") 120 that holds the male terminals 110, a shield structure 130 that prevents infiltration of external noise, and a seal member 140 that prevents infiltration of liquid from the outside (FIG. 6). In this fitting connector, when the fitting state between the female housing 20 and the male housing 120, along with the insertion and fitting of the housings, is in a complete fitting state, the female terminals 10 and the male terminals 110 are electrically connected. In this example, the male housing 120 is inserted to the inside of the female housing 20. Furthermore, in this example, two sets of a combination in which the female terminal 10 and the male terminal 110 are physically and electrically connected are provided. In the first connector 1, two female terminals 10 are arranged side by side at intervals in the orthogonal direction (the first orthogonal direction) with respect to the connector insertion-removal direction. In the second connector, two male terminals 110 are arranged side by side at intervals in the orthogonal direction (the first orthogonal direction) with respect to the connector insertion-removal direction.

In addition, in this fitting connector, a seal member 50 that improves liquid-tightness at a fitting portion between the first connector 1 and the second connector 2 is provided (FIG. 4 and FIG. 5). In this example, the seal member 50 is provided on the first connector 1. Furthermore, in this fitting connector, provided is, between the first connector 1 and the second connector 2, a holding structure 60 that maintains the fitting state between the female housing 20 and the male housing 120 (hereinafter also referred to as "between the housings") in a complete fitting state as is (FIG. 1 to FIG. 4, and FIG. 6).

The female terminal 10 includes a terminal connection portion 11 that is physically and electrically connected to the male terminal 110, and a wire connection portion 12 that is physically and electrically connected to an electric wire W1 (FIG. 5). The male terminal 110 includes, as with the female terminal 10, a terminal connection portion 111 that is physically and electrically connected to the female terminal 10, and a wire connection portion 112 that is physically and electrically connected to an electric wire W2 (FIG. 6). In this example, the terminal connection portion 111 of the male terminal 110 is formed in a columnar shape for which the axial direction is matched to the connector insertion-removal direction and, in order to insert and fit the terminal connection portion 111 into the inside, the terminal connection portion 11 of the female terminal 10 is formed in a cylindrical shape matching with the shape of the terminal connection portion 111. Each of the wire connection portions 12 and 112 is formed so that the respective electric wires W1 and W2 can be drawn out to the connector removal direction. The wire connection portions 12 and 112 of this example are swaged to and pressed to core wires W1*a* and W2*a* of the terminals of the electric wires W1 and W2, thereby electrically connecting to the core wires W1*a* and W2*a*.

The female housing 20 and the male housing 120 are shaped in respective predetermined shapes with an insulative material such as synthetic resin material. The female housing 20 and the male housing 120 of this example each include a tubular hood having the connector insertion-removal direction as a tube axial direction as described later. Each hood uses its internal space as a terminal housing chamber and, in this internal space, terminal holding bodies are arranged in an integrated state. When the female housing 20 and the male housing 120 are in a fitting state, one hood is accommodated in the other hood. At that time, the respective tube axes roughly match. That is, in this fitting connector, the tube axial directions of the respective hoods of the female housing 20 and the male housing 120 are the connector insertion-removal direction.

Specifically, the female housing 20 is in a two-block construction of an outer housing 20A and an inner housing 20B (FIG. 3 and FIG. 4).

The outer housing 20A is a tubular housing having the connector insertion-removal direction as the tube axial direction, and constitutes the foregoing hood of the female housing 20. This outer housing 20A is open at both ends in the tube axial direction. The outer housing 20A of this example is shaped in an angular cylindrical shape that has first and second walls 20$A_1$ and 20$A_2$ that are in a substantially rectangular shape and are opposingly arranged at intervals in the first orthogonal direction, and third and fourth walls 20$A_3$ and 20$A_4$ that are in a substantially rectangular shape and are opposingly arranged at intervals in the second orthogonal direction (FIG. 3 and FIG. 4). In the female housing 20, the inner housing 20B is housed and held in the rectangular parallelepiped internal space surrounded by the first to the fourth walls 20$A_1$, 20$A_2$, 20$A_3$, and 20$A_4$. An assurance member 80, which will be described later, is attached to this outer housing 20A.

The inner housing 20B includes terminal housing portions 21 in which the respective female terminals 10 are housed, and terminal holding portions 22 as the foregoing terminal holding bodies for the respective female terminals 10 (FIG. 4 and FIG. 5). The terminal housing portion 21 is formed in a tubular shape for which the connector insertion-removal direction is the tube axial direction and in which both ends are opened, and in the inside, respective terminal housing chambers (depiction omitted) for the female terminals 10 are formed. The terminal holding portion 22 is formed in a tubular shape for which the connector insertion-removal direction is the tube axial direction and in which both ends are opened, and is made to extend along the connector insertion direction from the opening at the end portion on the connector insertion direction side in the terminal housing portion 21. Two pieces of this terminal holding portion 22 for each female terminal 10 are arranged side by side. In this example, each terminal holding portion 22 is arranged in the first orthogonal direction. In each terminal holding portion 22, the inner space is a terminal housing chamber (depiction omitted), and each terminal housing chamber is made to communicate with the terminal housing chamber of the terminal housing portion 21 via the opening at the end portion on the connector removal direction side.

This inner housing 20B is inserted to the inner space from the opening on the connector insertion direction side of the outer housing 20A, and detaching from the opening is restrained by a latching mechanism 23 at the terminal housing portion 21 (FIG. 4). The latching mechanism 23 is made up of latch portions such as claw portions provided on each of the inner peripheral surface of the outer housing 20A and the terminal housing portion 21, and restricts the movement on the connector insertion direction side of the inner housing 20B with respect to the outer housing 20A. This latching mechanism 23 arranges the claw portions, by making the claw portions of the inner housing 20B climb over the claw portions of the outer housing 20A along with the insertion operation of the inner housing 20B to the inner space of the outer housing 20A, in a state where the respective claw portions can latch.

In this female housing 20, elastic members 24 are interposed between the outer housing 20A and the inner housing 20B (FIG. 4 and FIG. 5). The elastic members 24 are each arranged at four corners on the connector removal direction side of the outer housing 20A and between the wall surface that partly closes the opening at each corner and the terminal housing portion 21. Each elastic member 24 is arranged so as to exert resilient force in the connector insertion-removal direction between them. In this example, a helical spring is used as the elastic member 24, and a shaft portion 21*a* that is inserted to and pivotally supports this elastic member 24 is provided at each of four corners of the terminal housing portion 21 (FIG. 5). Each elastic member 24 is compressed when the claw portions of the inner housing 20B climb over the claw portions of the outer housing 20A, and causes the latch portions of the latching mechanism 23 to latch together by the resilient force in the extension direction as the reaction force.

The female terminal 10 is inserted from the opening at the end portion on the connector removal direction side in the terminal housing portion 21 together with the terminal of the electric wire W1, and is housed in the terminal housing chamber of the terminal housing portion 21 and the terminal housing chamber of the terminal holding portion 22. In the terminal housing chamber of the terminal housing portion 21, the wire connection portion 12 of the female terminal 10 and the terminal of the electric wire W1 connected to this wire connection portion 12 are housed. In the terminal housing chamber of the terminal holding portion 22, the terminal connection portion 11 of the female terminal 10 is housed and held.

The electric wire W1 is drawn out toward the outside from the opening at the end portion on the connector removal direction side in the terminal housing portion 21. Thus, in each terminal housing chamber of the terminal housing portion 21, the annular seal member 40 that is coaxial with the electric wire W1 and lets the electric wire W1 pass through is deployed. The seal member 40 causes a sheath W1*b* (FIG. 5) of the electric wire W1 to tightly adhere to the inner peripheral surface and causes the inner peripheral surface of the terminal housing chamber of the terminal housing portion 21 to tightly adhere to the outer peripheral surface, thereby preventing infiltration of liquid (such as water) into the inside of the terminal holding portion 22 from the electric wire W1 side.

The shield structure 30 is for preventing infiltration of external noise into the female terminals 10 and the terminals of the electric wires W1 that are housed in this female housing 20. The shield structure 30 of this example includes a shield shell 31 (FIG. 1 to FIG. 5).

The shield shell 31 is of a tubular shape molded with a conductive material such as metal, and is shaped into a tubular shape for which the tube axial direction is the connector insertion-removal direction and in which both ends are opened. In this shield shell 31, the terminal housing portion 21 of the inner housing 20B is arranged on the same tube axis, and the inner housing 20B is integrally shaped at the terminal housing portion 21 by insert molding or the like.

The shield shell 31 of this example exposes, in a state after shaping of the inner housing 20B, the outer peripheral surface of the end portion on the connector insertion direction side. In this shield shell 31, after completing fitting in the second connector 2, the exposed surface on the connector insertion direction side is physically and electrically connected to a shield shell 131 of the second connector 2.

The shield shell 31 of this example is made to project from the end portion on the connector removal direction side of the terminal housing portion 21. In this shield shell 31, two electric wires W1 are drawn out from the end portion on the connector removal direction side of the projecting portion. In the inside of this shield shell 31, a holding member (what is called a rear holder) 25 that holds the two electric wires W1 is inserted (FIG. 5). The holding member 25 is shaped with an insulative material such as synthetic resin. In the shield shell 31, the outer peripheral surface of the projecting portion, together with the drawn out electric wires W1, is covered with a braid (depiction omitted). The braid is a member braided in a tubular and mesh-like shape with a conductive material such as metal.

In the first connector 1 of this example, a tubular space S for which the end portion on the connector insertion direction side is opened is formed on the connector insertion direction side relative to the exposed surface on the connector insertion direction side of the shield shell 31 and is formed between the outer housing 20A and the inner housing 20B and between the outer housing 20A and the shield shell 31 (FIG. 1 and FIG. 3). The second connector 2 is fitted in the first connector 1 while being inserted to the tubular space S from the opening. At that time, in the inside of the outer housing 20A, the connector insertion direction side in the second connector 2 is housed. Then, in the inside of the male housing 120 on the connector insertion direction side in the second connector 2, inserted are the end portion on the connector insertion direction side in the terminal housing portion 21, the end portion on the connector insertion direction side in the shield shell 31, and the terminal holding portion 22. The male terminal 110 is, along with the insertion thereof, inserted into the inside of the terminal connection portion 11 via the opening of the terminal holding portion 22. Thus, the seal member 50 is annularly shaped, and lets the end portion on the connector insertion direction side in the terminal housing portion 21 pass through. Then, the seal member 50 causes the inner peripheral surface to tightly adhere to the end portion of the terminal housing portion 21 and causes the outer peripheral surface to tightly adhere to the inner peripheral surface of the male housing 120 inserted to the space S. Note that the opening at the end portion on the connector insertion direction side of the terminal housing portion 21 is closed except for the portion communicating with the terminal holding portion 22.

The male housing 120 is a counterpart tubular housing having the connector insertion-removal direction as the tube axial direction, and is inserted to and fitted in the inner space of the female housing 20 (the tubular space S of the first connector 1). This male housing 120 includes a terminal housing portion 121 in which the respective male terminals 110 are housed, and terminal holding portions 122 having the function as the foregoing terminal holding body for each male terminal 110 (FIG. 3 and FIG. 6). The terminal housing portion 121 is formed in a tubular shape for which the connector insertion-removal direction is the tube axial direction and in which both ends are opened, and in the inside, respective terminal housing chambers (depiction omitted) for the male terminals 110 are formed. The end portion on the connector insertion direction side in the terminal housing portion 121 constitutes the foregoing hood, and is inserted to the tubular space S of the first connector 1. The outer peripheral surface of the seal member 50 is made to tightly adhere to the inner peripheral surface of the end portion. The terminal housing portion 121 of this example is shaped in a tubular shape matching with the shapes of the outer peripheral surface of the terminal housing portion 21 of the inner housing 20B and the outer peripheral surface of the shield shell 31. The terminal holding portion 122 is formed in a tubular shape for which the connector insertion-removal direction is the tube axial direction and in which both ends are opened, and in the inside, respective terminal housing chambers (depiction omitted) for the male terminals 110 are formed. This terminal holding portion 122 is arranged at the opening of the end portion on the connector removal direction side of the terminal housing portion 121. The terminal housing chambers of the terminal holding portion 122 are made to communicate with the terminal housing chambers of the terminal housing portion 121 via the opening at the end portion on the connector insertion direction side.

The male terminal 110 is inserted from the opening at the end portion on the connector removal direction side in the terminal holding portion 122 together with the terminal of the electric wire W2, and is housed in the terminal housing chamber of the terminal housing portion 121 and the terminal housing chamber of the terminal holding portion 122. In the terminal housing chamber of the terminal housing portion 121, the terminal connection portion 111 of the male terminal 110 is housed. In the terminal housing chamber of the terminal holding portion 122, the wire connection portion 112 of the male terminal 110 and the terminal of the electric wire W2 connected to the wire connection portion 112 are housed.

The electric wire W2 is drawn out toward the outside from the opening at the end portion on the connector removal direction side in the terminal holding portion 122. Thus, in each terminal housing chamber of the terminal holding portion 122, the annular seal member 140 that is coaxial with the electric wire W2 and lets the electric wire W2 pass through is deployed. The seal member 140 causes a sheath W2*b* (FIG. 6) of the electric wire W2 to tightly adhere to the inner peripheral surface and causes the inner peripheral surface of the terminal housing chamber of the terminal holding portion 122 to tightly adhere to the outer peripheral surface, thereby preventing infiltration of liquid (such as water) into the inside of the terminal housing portion 121 from the electric wire W2 side.

The shield structure 130 is for preventing infiltration of external noise into the male terminals 110 and the terminals of the electric wires W2 that are housed in the male housing 120. The shield structure 130 of this example includes the shield shell 131 (FIG. 1 to FIG. 3, and FIG. 6).

The shield shell 131 is of a tubular shape molded with a conductive material such as metal, and is shaped into a tubular shape for which the tube axial direction is the connector insertion-removal direction and in which both ends are opened. In this shield shell 131, it is arranged to extend from the terminal housing portion 121 in the male housing 120 over the terminal holding portion 122, and the male housing 120 is integrally shaped by insert molding or the like.

The shield shell 131 of this example exposes, in a state after shaping the male housing 120, the inner peripheral surface of the end portion on the connector insertion direction side. In this shield shell 131, after completing fitting in the first connector 1, the exposed surface on the connector insertion direction side is physically and electrically connected to the shield shell 31 of the first connector 1.

The shield shell 131 of this example is made to project from the end portion on the connector removal direction side of the male housing 120. In this shield shell 131, two electric wires W2 are drawn out from the end portion on the connector removal direction side of the projecting portion. In the inside of the shield shell 131, a holding member (what is called a rear holder) 125 that holds the two electric wires W2 is inserted (FIG. 1, FIG. 3, and FIG. 6). The holding member 125 is shaped with an insulative material such as synthetic resin. In the shield shell 131, the outer peripheral surface of the projecting portion, together with the drawn out electric wires W2, is covered with a braid (depiction omitted). The braid is a member braided in a tubular and mesh-like shape with a conductive material such as metal.

In this fitting connector, when the fitting state of the female housing 20 and the male housing 120 is in a complete fitting state, the holding structure 60 restricts the relative movement of the respective housings in the connector removal direction between the housings, so as to maintain the female housing 20 and the male housing 120 in the complete fitting state as is. This holding structure 60 includes a first latch hold portion 61 provided on the female housing 20 and a second latch hold portion 62 provided on the male housing 120 (FIG. 1 to FIG. 3) and, by making the first latch hold portion 61 and the second latch hold portion 62 be in a state capable of latching in the connector removal direction when the female housing 20 and the male housing 120 are in a complete fitting state, maintains the fitting state in the complete fitting state as is. One of the first latch hold portion 61 and the second latch hold portion 62 is formed as a hole portion or a groove portion, and the other one is formed as a protrusion portion to insert to the hole portion or the groove portion. In this example, the first latch hold portion 61 is formed as a hole portion and the second latch hold portion 62 is formed as a protrusion portion.

In this holding structure 60, the second latch hold portion 62 is made to project from the outer wall portion of the male housing 120. The holding structure 60 further includes a latch hold body 70 on which the first latch hold portion 61 is provided (FIG. 1 to FIG. 3). The latch hold body 70 is formed integrally with the outer housing 20A of the female housing 20.

The latch hold body 70 includes the first latch hold portion 61 provided on one end in the connector insertion-removal direction, and a latch-release operation portion 72 provided on the other end in the connector insertion-removal direction (FIG. 1 to FIG. 3). The latch hold body 70 of this example is, on the outer housing 20A, provided with the first latch hold portion 61 on one end on the connector insertion direction side and provided with the latch-release operation portion 72 on the other end on the connector removal direction side. The latch-release operation portion 72 is a region to be pushed when releasing a state where the first latch hold portion 61 and the second latch hold portion 62 can latch or a latched state.

The latch hold body 70 further includes a latch arm portion 73 of a cantilever on which the first latch hold portion 61 is provided at a free end and arranged between the first latch hold portion 61 and the latch-release operation portion 72 (FIG. 1 to FIG. 3). The latch arm portion 73 connects a fixed end to the outer wall surface of the outer housing 20A. The latch hold body 70 is connected to the outer wall surface of the outer housing 20A in a cantilever state via the fixed end of the latch arm portion 73.

Figure 7:
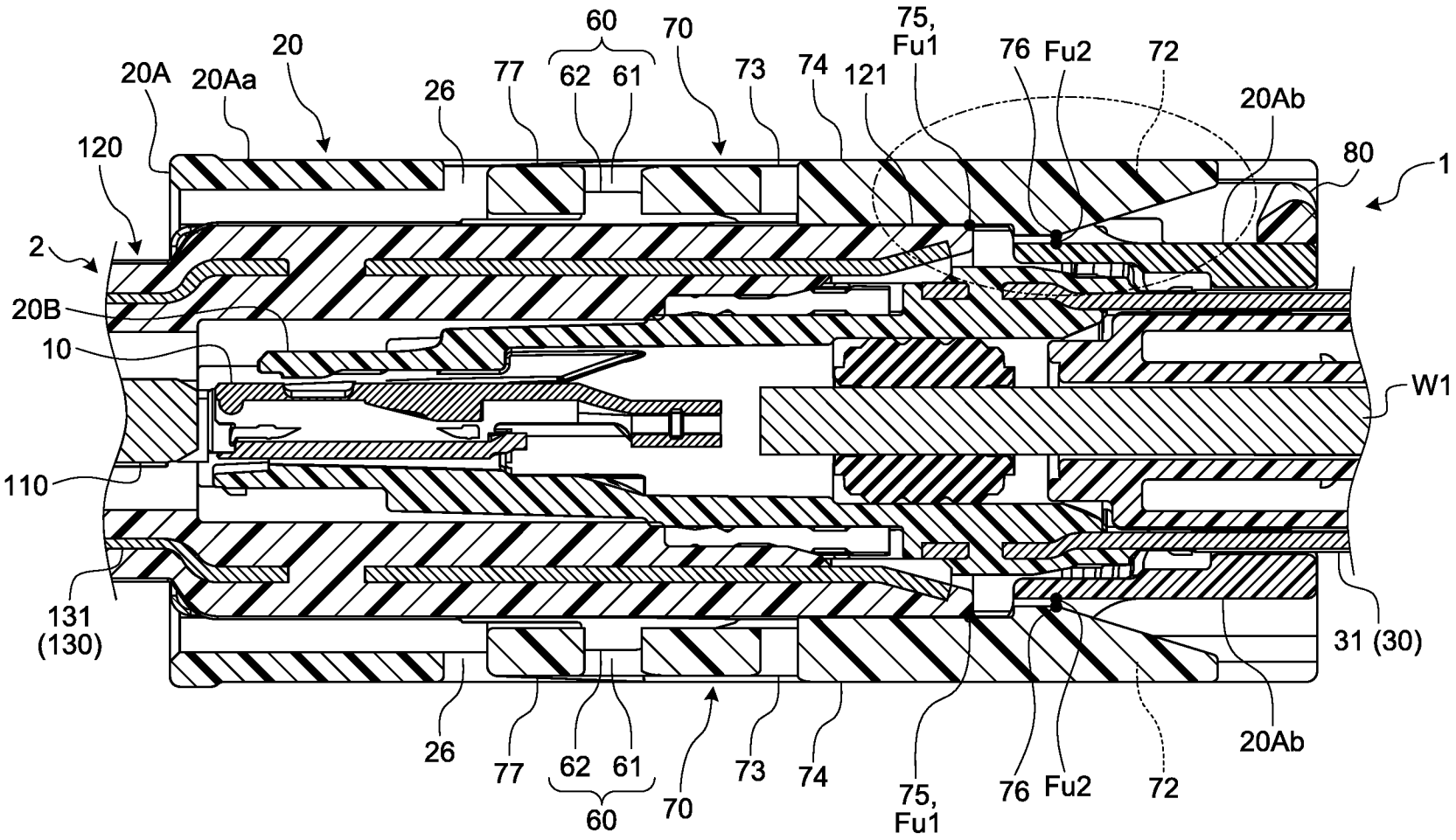
FIG. 7 is a cross-sectional view at the line X-X in FIG. 2.
Figure 8:
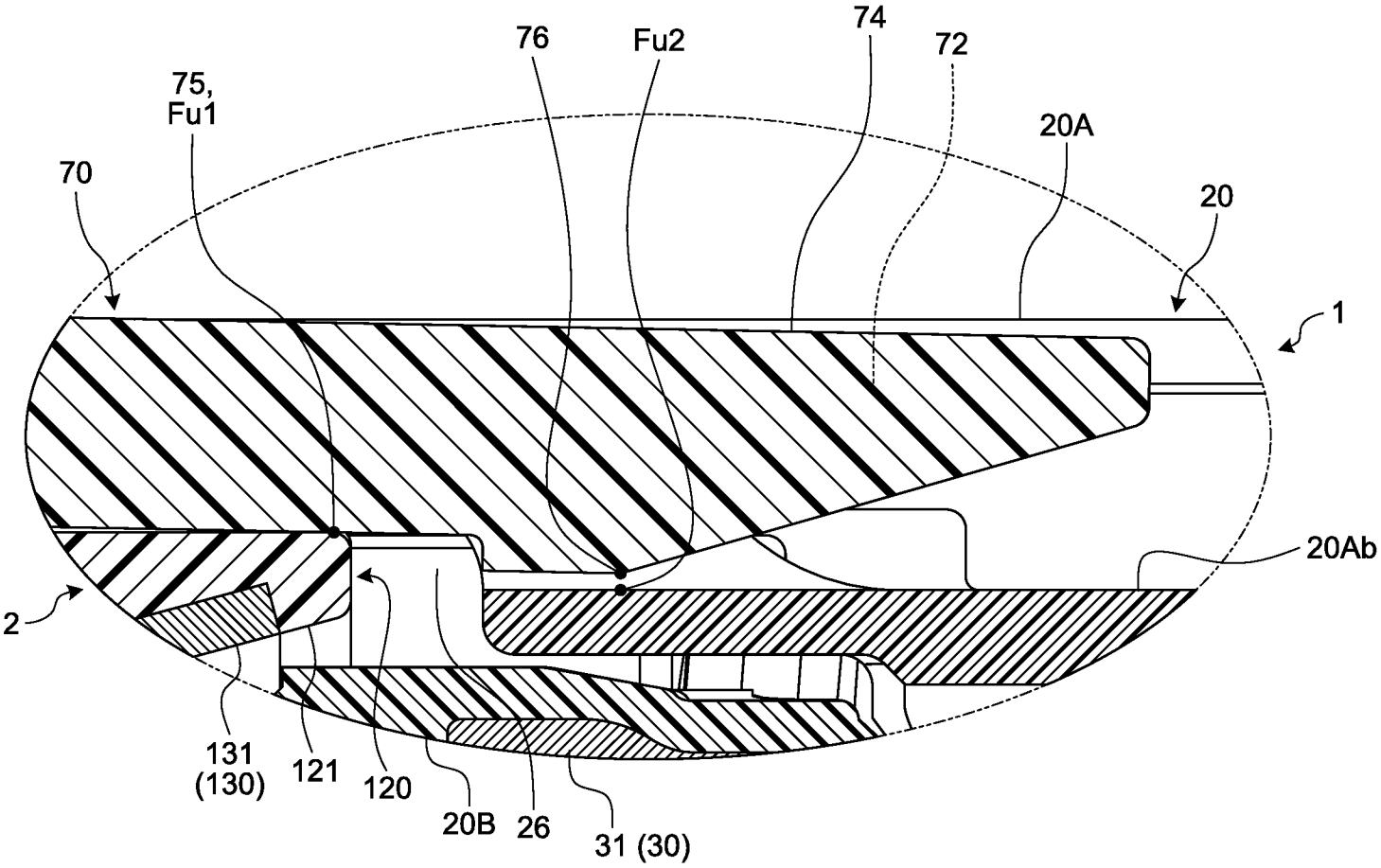
FIG. 8 is a cross-sectional view for explaining a latch release operation at the time a first fulcrum is a fulcrum.
Figure 9:
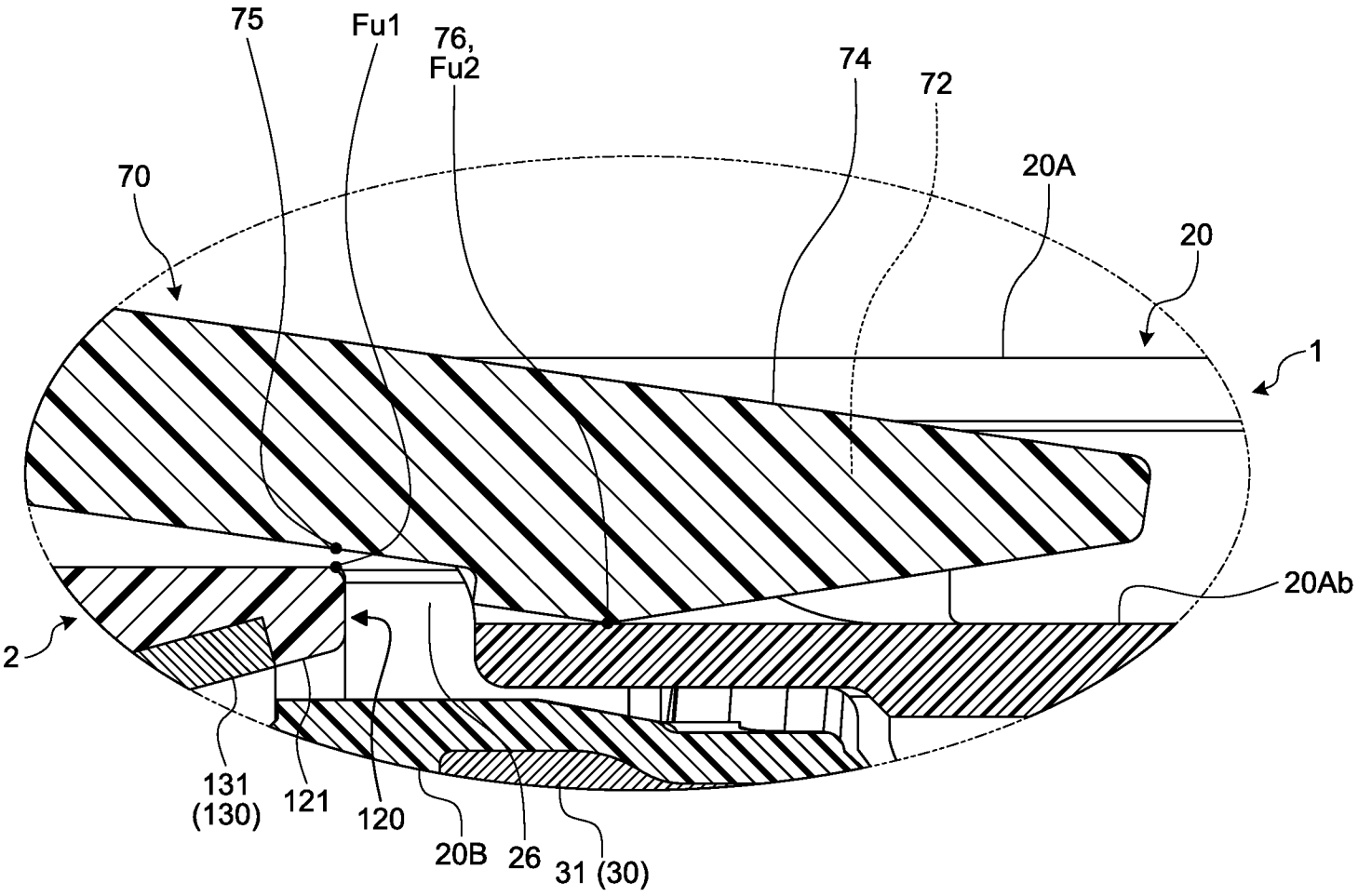
FIG. 9 is a cross-sectional view for explaining the latch release operation at the time a second fulcrum is the fulcrum.

The latch hold body 70 further includes latch-release arm portions 74 that couple the first latch hold portion 61 and the latch-release operation portion 72 (FIG. 1 to FIG. 3). The latch-release arm portions 74, when the latch-release operation portion 72 is pushed, exert the force corresponding to the push operation force thereof (release operation force) on the first latch hold portion 61. Consequently, the latch hold body 70 includes a first fulcrum portion 75 and a second fulcrum portion 76 provided on the latch-release arm portion 74 (FIG. 7 to FIG. 9). In this latch hold body 70, the first fulcrum portion 75 is provided on the first latch hold portion 61 side, and the second fulcrum portion 76 is provided on the latch-release operation portion 72 side (FIG. 7). Then, in this holding structure 60, receiving portions that receive the force in applying the push operation force (release operation force) to the latch-release operation portion 72 (hereinafter referred to as "release-operation force receiving portions") are provided corresponding to the first fulcrum portion 75 and to the second fulcrum portion 76. In this holding structure 60, a first release-operation force receiving portion Fu1 corresponding to the first fulcrum portion 75 and a second release-operation force receiving portion Fu2 corresponding to the second fulcrum portion 76 are provided (FIG. 7 to FIG. 9). The first release-operation force receiving portion Fu1 and the second release-operation force receiving portion Fu2 are provided on the female housing 20 or the male housing 120.

In this latch hold body 70, when push operation is performed on the latch-release operation portion 72 as a point of effort, with the contact point between the first fulcrum portion 75 and the first release-operation force receiving portion Fu1 as illustrated in FIG. 8 as a fulcrum, the force corresponding to the push operation force is exerted on the first latch hold portion 61. Then, in this latch hold body 70, when the push operation is continued, the fulcrum is moved to the contact point that is between the second fulcrum portion 76 provided on the latch-release operation portion 72 side relative to the first fulcrum portion 75 and the second release-operation force receiving portion Fu1 as illustrated in FIG. 9, and the force corresponding to the push operation force is exerted on the first latch hold portion 61. That is, the first fulcrum portion 75 is provided on the latch-release arm portion 74 so that, when the latch-release operation portion 72 as the point of effort is pushed in a state where the first latch hold portion 61 and the second latch hold portion 62 can latch, with the contact point with the first release-operation force receiving portion Fu1 as a fulcrum, the force in the detaching direction from the second latch hold portion 62 is exerted on the first latch hold portion 61 as a point of action. The second fulcrum portion 76 is provided on the latch-release arm portion 74 so that, along with the continuation of the push operation, the second fulcrum portion 76 comes in contact with the second release-operation force receiving portion Fu2 on the latch-release operation portion 72 side relative to the first release-operation force receiving portion Fu1 and, with the contact point with the second release-operation force receiving portion Fu2 as a new fulcrum, exerts the force in the detaching direction from the second latch hold portion 62 on the first latch hold portion 61 as a point of action.

In order to implement such series of movement, a first fulcrum by the contact point between the first fulcrum portion 75 and the first release-operation force receiving portion Fu1 is, as viewed in the push operation direction for the latch-release operation portion 72, provided on the near side relative to a second fulcrum by the contact point between the second fulcrum portion 76 and the second release-operation force receiving portion Fu2.

In this example, a through-hole 26 is provided on the outer peripheral wall of the outer housing 20A (FIG. 1 to FIG. 3, and FIG. 7). The latch hold body 70 makes at least the first latch hold portion 61 be opposingly arranged to the through-hole 26. In the through-hole 26, the second latch hold portion 62 provided on the outer wall surface of the male housing 120 is also opposingly arranged when the fitting state between the housings is in a complete fitting state.

Specifically, the outer housing 20A of this example includes, as the outer wall surfaces, a main-outer wall surface 20Aa constituting a contour shape, and a sub-outer wall surface 20Ab that is offset toward the inner space side relative to the main-outer wall surface 20Aa (FIG. 4 and FIG. 7).

The latch hold body 70 connects the fixed end of the latch arm portion 73 to the sub-outer wall surface 20Ab and arranges it on the inner space side relative to the main-outer wall surface 20Aa. The foregoing through-hole 26 is formed on the connector insertion direction side relative to the sub-outer wall surface 20Ab. Accordingly, in the latch hold body 70 of this example, the first latch hold portion 61, the free end side relative to the fixed end in the latch arm portion 73, and the first latch hold portion 61 side relative to the position of the fixed end of the latch arm portion 73 in the latch-release arm portion 74 are arranged at the through-hole 26. Then, in this latch hold body 70, the fixed end of the latch arm portion 73 is connected to the sub-outer wall surface 20Ab, and the latch-release operation portion 72 and the portion up to the latch-release operation portion 72 from the position of the fixed end of the latch arm portion 73 in the latch-release arm portion 74 are opposingly arranged to the sub-outer wall surface 20Ab at intervals. The latch-release operation portion 72 is pushed toward the sub-outer wall surface 20Ab in performing latch release operation.

In this example, the through-hole 26 is formed to be opposingly arranged to the first fulcrum portion 75 also. In the latch hold body 70, the first fulcrum portion 75 is arranged at the through-hole 26, and the second fulcrum portion 76 is opposingly arranged to the sub-outer wall surface 20Ab at intervals (FIG. 7). Thus, in the holding structure 60 of this example, the opposing wall surface to the first fulcrum portion 75 in the outer wall surface of the terminal housing portion 121 via the through-hole 26 is used as the first release-operation force receiving portion Fu1. In this case, the peripheral edge portion of the opening on the connector insertion direction side in the opposing wall surface is used as the first release-operation force receiving portion Fu1. Furthermore, the holding structure 60 of this example uses the opposing wall surface to the second fulcrum portion 76 in the outer peripheral wall of the outer housing 20A as the second release-operation force receiving portion Fu2. In this case, the opposing wall surface to the second fulcrum portion 76 in the sub-outer wall surface 20Ab is used as the second release-operation force receiving portion Fu2. The outer wall surface of the terminal housing portion 121 in this example is, as viewed in the push operation direction for the latch-release operation portion 72, provided on the near side relative to the sub-outer wall surface 20Ab.

The interval between the first fulcrum portion 75 and the first release-operation force receiving portion Fu1 and the interval between the second fulcrum portion 76 and the second release-operation force receiving portion Fu2 are set depending on the timing of switching from the fulcrum at the contact point between the first fulcrum portion 75 and the first release-operation force receiving portion Fu1 to the fulcrum at the contact point between the second fulcrum portion 76 and the second release-operation force receiving portion Fu2, for example. The first fulcrum portion 75 and the second fulcrum portion 76, depending on the timing of switching thereof, may be the use of the wall surface of the latch-release arm portion 74, or may be the use of a projecting portion projecting from the wall surface of the latch-release arm portion 74. In this case, the wall surface of the latch-release arm portion 74 is used as the first fulcrum portion 75, and the projecting portion projecting from the wall surface of the latch-release arm portion 74 is used as the second fulcrum portion 76 (FIG. 7).

The latch hold body 70 of this example includes one latch arm portion 73 extending toward the connector insertion direction side from the fixed end, and at the free end on the extending direction in the latch arm portion 73, the through-hole-shaped first latch hold portion 61 is provided (FIG. 1 to FIG. 4). The through-hole-shaped first latch hold portion 61 causes the second latch hold portion 62 to latch the wall portion on the connector insertion direction side in the peripheral edge portion of the through hole, when the protrusion-shaped second latch hold portion 62 is inserted. The latch hold body 70 of this example includes a rectangular piece portion 77 on the connector insertion direction side relative to the first latch hold portion 61 (FIG. 1 to FIG. 3, and FIG. 7). In this case, the second latch hold portion 62 is made to latch the wall portion constituting the through-hole-shaped first latch hold portion 61 in the piece portion 77.

The latch hold body 70 of this example includes two latch-release arm portions 74 arranged so as to sandwich the first latch hold portion 61 and the latch arm portion 73 at intervals in the connector insertion-removal direction and in the orthogonal direction (first orthogonal direction) with respect to the opposingly arranged direction of the latch-release operation portion 72 and the sub-outer wall surface 20Ab (FIG. 1 to FIG. 4). The latch-release arm portions 74 are extended in the connector insertion-removal direction, and one end on the connector insertion direction side is coupled to the piece portion 77 and the other end on the connector removal direction side is coupled to the latch-release operation portion 72. The first fulcrum portion 75 and the second fulcrum portion 76 are provided on the respective latch-release arm portions 74.

The latch hold body 70 of this example arranges the latch-release operation portion 72 on the connector removal direction side relative to the fixed end of the latch arm portion 73 (FIG. 1 to FIG. 4). The latch-release operation portion 72 of this example is formed as a rectangular piece portion.

In the fitting connector of this example, the above-described holding structure 60 is provided at two locations. In this case, the through-hole 26 and the sub-outer wall surface 20Ab are provided on a part of each of the third and the fourth walls 20$A_3$ and 20$A_4$, the respective through-holes 26 are opposingly arranged at intervals in the second orthogonal direction, and the respective sub-outer wall surfaces 20Ab are opposingly arranged at intervals in the second orthogonal direction. In the outer housing 20A, on each sub-outer wall surface 20Ab of the third and the fourth walls 20$A_3$ and 20$A_4$, one each of the latch hold body 70 is provided. In the outer peripheral surface of the male housing 120, on the portion opposingly arranged to each through-hole 26, one each of the second latch hold portion 62 is provided.

In the holding structure 60 in the foregoing, at an initial stage where latch release operation is performed on the latch-release operation portion 72, with the contact point between the first fulcrum portion 75 and the first release-operation force receiving portion Fu1 as the fulcrum (first fulcrum), the force in the detaching direction from the second latch hold portion 62 is exerted on the first latch hold portion 61, and thereafter, the fulcrum is moved to the contact point (second fulcrum) between the second fulcrum portion 76 on the latch-release operation portion 72 side relative to the first fulcrum and the second release-operation force receiving portion Fu2, and the force in the detaching direction from the second latch hold portion 62 is exerted on the first latch hold portion 61. For example, assuming that the second fulcrum by the second fulcrum portion 76 and the second release-operation force receiving portion Fu2 is a conventional fulcrum, in this holding structure 60, because the first fulcrum is provided on the first latch hold portion 61 side relative to the second fulcrum, it is possible to increase the force in the detaching direction from the second latch hold portion 62 in the first latch hold portion 61 while reducing the initial push operation force for the latch-release operation portion 72 relative to the conventional case. Meanwhile, in this holding structure 60, by providing the first fulcrum closer to the first latch hold portion 61 side, a relative movement amount in the detaching direction of the first latch hold portion 61 with respect to the second latch hold portion 62 is made smaller relative to the conventional case. However, in this holding structure 60, because the fulcrum switches to the second fulcrum from the first fulcrum by the continuation of the push operation for the latch-release operation portion 72, it is possible to ensure the relative movement amount in the detaching direction of the first latch hold portion 61 with respect to the second latch hold portion 62 while suppressing an increase in the amount of push operation for the latch-release operation portion 72. That is, in this holding structure 60, it is possible to release a state capable of latching between the first latch hold portion 61 and the second latch hold portion 62 while reducing the push operation force for the latch-release operation portion 72 and suppressing an increase in the push operation amount for the latch-release operation portion 72.

In particular, in this fitting connector, when the first connector 1 and the second connector 2 are inserted and fitted in, by the pushing force toward the inner housing 20B from the second connector 2 side, each of the foregoing elastic members 24 is compressed. Then, in this fitting connector, when the fitting state between the housings is turned into a complete fitting state, the male housing 120 is pushed back via the inner housing 20B by the resilient force in the extension direction of each elastic member 24, and the first latch hold portion 61 and the second latch hold portion 62 are made to latch. That is, the elastic members 24 of the first connector 1 exert the resilient force in the connector removal direction on each of the first connector and the second connector, when the fitting state between the housings is in a complete fitting state, and cause the first latch hold portion 61 and the second latch hold portion 62 to be in a latched state in the connector removal direction by the resilient force, and to maintain the fitting state in the complete fitting state as is. Thus, in this fitting connector, there is a need to exert the force resisting against the static frictional force between the first latch hold portion 61 and the second latch hold portion 62 on the first latch hold portion 61 in latch release operation. However, the holding structure 60 causes the first latch hold portion 61 to detach from the second latch hold portion 62 by switching two fulcrums as in the foregoing, and thus it is possible to exert the force resisting against the static frictional force between the first latch hold portion 61 and the second latch hold portion 62 on the first latch hold portion 61 while reducing the push operation force for the latch-release operation portion 72 and suppressing an increase in the push operation amount for the latch-release operation portion 72. That is, this holding structure 60 causes the first latch hold portion 61 to detach from the second latch hold portion 62 by switching two fulcrums as in the foregoing, and thus, it is possible to release a latched state between the first latch hold portion 61 and the second latch hold portion 62, while reducing the push operation force for the latch-release operation portion 72 and suppressing an increase in the push operation amount for the latch-release operation portion 72 and while ensuring the holding force (static frictional force) between the first latch hold portion 61 and the second latch hold portion 62 that is before latch release operation.

In the fitting connector, by increasing in size of the latch hold body 70 by changing the lever ratio, it is possible to release a state capable of latching between the first latch hold portion 61 and the second latch hold portion 62 or a latched state, while reducing the push operation force for the latch-release operation portion 72 and suppressing an increase in the push operation amount for the latch-release operation portion 72 and while ensuring the holding force (static frictional force) between the first latch hold portion 61 and the second latch hold portion 62. However, in this case, along with the increase in size of the latch hold body 70, it leads to an increase in the physical size of the fitting connector. The fitting connector of the present embodiment can also prevent such an increase in the physical size, because there is no need to increase in size of the latch hold body 70.

In the fitting connector, even if the cross-sectional area of the orthogonal cross-section with respect to the axis line of the latch arm portion 73 is reduced, it is possible to release a state capable of latching between the first latch hold portion 61 and the second latch hold portion 62 or a latched state, while reducing the push operation force for the latch-release operation portion 72 and suppressing an increase in the push operation amount for the latch-release operation portion 72 and while ensuring the holding force (static frictional force) between the first latch hold portion 61 and the second latch hold portion 62. However, in this case, because the strength of the latch arm portion 73 is reduced, it may lead to the reduction in durability of the holding structure 60. The fitting connector of the present embodiment can also prevent such reduction in durability of the holding structure 60.

As in the foregoing, in the fitting connector of the present embodiment, the holding structure 60 configured to cause the first latch hold portion 61 to detach from the second latch hold portion 62 by switching two fulcrums is included, and it is possible to release a state capable of latching between the first latch hold portion 61 and the second latch hold portion 62 or a latched state, while reducing the push operation force for the latch-release operation portion 72 and suppressing an increase in the push operation amount for the latch-release operation portion 72 and while ensuring the holding force (static frictional force) between the first latch hold portion 61 and the second latch hold portion 62 until performing latch release operation. Accordingly, this fitting connector makes it possible to improve usability in performing the latch release operation in the holding structure 60.

Incidentally, in this fitting connector, provided is an assurance member 80 that, when the fitting state between the housings is in a complete fitting state, restricts the movement in the detaching direction of the first latch hold portion 61 with respect to the second latch hold portion 62, and assures that the fitting state is in the complete fitting state (FIG. 1 to FIG. 4). The assurance member 80 restricts the movement in the detaching direction of the first latch hold portion 61 and maintains the state where the first latch hold portion 61 and the second latch hold portion 62 can latch, thereby assuring that the fitting state is in a complete fitting state.

The assurance member 80 is a member capable of relatively moving in the connector insertion-removal direction with respect to the female housing 20. This assurance member 80 is assembled to the female housing 20 so as to be relatively movable in the connector insertion-removal direction between a final latch position and a provisional latch position when the fitting state between the housings is in a complete fitting state. The assurance member 80 of this example is assembled so as to be relatively movable in the connector insertion-removal direction with respect to the outer housing 20A.

The final latch position means the position at which, out of the relative positions of the assurance member 80 with respect to the female housing 20, the movement in the detaching direction of the first latch hold portion 61 with respect to the second latch hold portion 62 is restricted. The assurance member 80 at the final latch position restricts the movement in the detaching direction of the first latch hold portion 61 with respect to the second latch hold portion 62, by latching any region in the latch hold body 70. The assurance member 80 of this example latches the latch-release operation portion 72 at the final latch position, thereby restricting the movement in the detaching direction of the first latch hold portion 61 with respect to the second latch hold portion 62. Meanwhile, the provisional latch position means a position at which, out of the relative positions of the assurance member 80 with respect to the female housing 20, the movement in the detaching direction thereof is not yet restricted. The assurance member 80 at the provisional latch position of this example is unable to latch the latch-release operation portion 72 and is unable to restrict the movement in the detaching direction of the first latch hold portion 61 with respect to the second latch hold portion 62.

Thus, if the fitting state between the housings is in a complete fitting state, it is possible to relatively move this assurance member 80 to the final latch position from the provisional latch position with respect to the female housing 20. Meanwhile, when the fitting state between the housings is in a half-fitting state, it is not possible to relatively move this assurance member 80 to the final latch position from the provisional latch position with respect to the female housing 20. Thus, this assurance member 80 can let a worker and the like determine that the fitting state between the housings (between the connectors) is in a complete fitting state, if it is possible to relatively move it from the provisional latch position to the final latch position. Meanwhile, this assurance member 80 can let the worker and the like determine that the fitting state between the housings (between the connectors) is in a half-fitting state, if it is not possible to relatively move it from the provisional latch position to the final latch position. That is, this assurance member 80 can be used also for detecting the fitting state between the housings.

This assurance member 80 embodies a function of assuring connector fitting position (connector position assurance (CPA)), and that is well known in the relevant technical field. Accordingly, the detailed description thereof is omitted.

In the holding structure of the fitting connector according to the present embodiment, at an initial stage where latch release operation is performed on the latch-release operation portion, with the contact point between the first fulcrum portion and the first release-operation force receiving portion as the fulcrum (first fulcrum), the force in the detaching direction from the second latch hold portion is exerted on the first latch hold portion, and thereafter, the fulcrum is moved to the contact point (second fulcrum) between the second fulcrum portion on the latch-release operation portion side relative to the first fulcrum and the second release-operation force receiving portion, and the force in the detaching direction from the second latch hold portion is exerted on the first latch hold portion. The fitting connector in the present embodiment includes the holding structure configured to switch such two fulcrums and cause the first latch hold portion to detach from the second latch hold portion, and when the latch release operation is performed, it is able to release a state capable of latching between the first latch hold portion and the second latch hold portion or a latched state, while reducing the push operation force for the latch-release operation portion and suppressing an increase in the push operation amount for the latch-release operation portion and while ensuring the holding force (static frictional force) between the first latch hold portion and the second latch hold portion until performing the latch release operation. Accordingly, this fitting connector makes it possible to improve usability in performing the latch release operation in the holding structure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fitting connector comprising:

a first connector that includes a terminal and a housing holding the terminal;

a second connector that includes a counterpart terminal and a counterpart housing holding the counterpart terminal, and is configured to electrically connect the terminal with the counterpart terminal when a fitting state between the housing and the counter housing along with insertion and fitting between the housing and the counter housing is in a complete fitting state; and a holding structure that includes a first latch hold portion provided on the housing and a second latch hold portion provided on the counterpart housing, is configured to cause the first latch hold portion and the second latch hold portion to be in a state capable of latching in a connector removal direction when the fitting state is in the complete fitting state, and maintains the fitting state in the complete fitting state as is, wherein the holding structure includes a latch hold body on which the first latch hold portion is provided, and the latch hold body includes the first latch hold portion provided on one end in a connector insertion-removal direction, a latch-release operation portion provided on the other end in the connector insertion-removal direction, a cantilever latch arm portion on which the first latch hold portion is provided at a free end and arranged between the first latch hold portion and the latch-release operation portion, a latch-release arm portion coupling the first latch hold portion and the latch-release operation portion, a first fulcrum portion provided on the latch-release arm portion and configured to exert force in a detaching direction from the second latch hold portion on the first latch hold portion as a point of action with a contact point with a first release-operation force receiving portion as a fulcrum when the latch-release operation portion as a point of effort is pushed in a state where the first latch hold portion and the second latch hold portion are able to latch, and a second fulcrum portion provided on the latch-release operation portion side relative to the first fulcrum portion in the latch-release arm portion and configured to contact with a second release-operation force receiving portion on the latch-release operation portion side relative to the first release-operation force receiving portion along with continuation of the push operation and exert the force in the detaching direction from the second latch hold portion on the first latch hold portion as a point of action with a contact point with the second release-operation force receiving portion as a new fulcrum.

2. The fitting connector according to claim 1, further comprising:

an elastic member configured to exert resilient force in the connector removal direction on each of the first connector and the second connector when the fitting state is in the complete fitting state, wherein the holding structure causes the first latch hold portion and the second latch hold portion to be in a latched state in the connector removal direction by the resilient force of the elastic member when the fitting state is in the complete fitting state, and maintains the fitting state in the complete fitting state as is.

3. The fitting connector according to claim 1, wherein a first fulcrum by the contact point between the first fulcrum portion and the first release-operation force receiving portion is, as viewed in a push operation direction for the latch-release operation portion, provided on a near side relative to a second fulcrum by the contact point between the second fulcrum portion and the second release-operation force receiving portion.

4. The fitting connector according to claim 2, wherein a first fulcrum by the contact point between the first fulcrum portion and the first release-operation force receiving portion is, as viewed in a push operation direction for the latch-release operation portion, provided on a near side relative to a second fulcrum by the contact point between the second fulcrum portion and the second release-operation force receiving portion.

5. The fitting connector according to claim 1, wherein the first release-operation force receiving portion and the second release-operation force receiving portion are provided on the housing or the counterpart housing.

6. The fitting connector according to claim 2, wherein the first release-operation force receiving portion and the second release-operation force receiving portion are provided on the housing or the counterpart housing.

7. The fitting connector according to claim 3, wherein the first release-operation force receiving portion and the second release-operation force receiving portion are provided on the housing or the counterpart housing.

8. The fitting connector according to claim 4, wherein the first release-operation force receiving portion and the second release-operation force receiving portion are provided on the housing or the counterpart housing.

9. The fitting connector according to claim 1, wherein the housing includes a tubular housing having the connector insertion-removal direction as a tube axial direction, and the latch hold body that is configured to connect a fixed end of the latch arm portion to an external wall surface of the tubular housing and make at least the first latch hold portion be opposingly arranged to a through-hole provided on the outer wall surface of the tubular housing, and the counterpart housing includes a counterpart tubular housing having the connector insertion-removal direction as a tube axial direction and configured to be inserted to and fitted in an internal space of the tubular housing, and the second latch hold portion projecting from an outer wall surface of the counterpart tubular housing.

10. The fitting connector according to claim 2, wherein the housing includes a tubular housing having the connector insertion-removal direction as a tube axial direction, and the latch hold body that is configured to connect a fixed end of the latch arm portion to an external wall surface of the tubular housing and make at least the first latch hold portion be opposingly arranged to a through-hole provided on the outer wall surface of the tubular housing, and the counterpart housing includes a counterpart tubular housing having the connector insertion-removal direction as a tube axial direction and configured to be inserted to and fitted in an internal space of the tubular housing, and the second latch hold portion projecting from an outer wall surface of the counterpart tubular housing.

11. The fitting connector according to claim 3, wherein the housing includes a tubular housing having the connector insertion-removal direction as a tube axial direction, and the latch hold body that is configured to connect a fixed end of the latch arm portion to an external wall surface of the tubular housing and make at least the first latch hold portion be opposingly arranged to a through-hole provided on the outer wall surface of the tubular housing, and the counterpart housing includes a counterpart tubular housing having the connector insertion-removal direction as a tube axial direction and configured to be inserted to and fitted in an internal space of the tubular housing, and the second latch hold portion projecting from an outer wall surface of the counterpart tubular housing.

12. The fitting connector according to claim 4, wherein the housing includes a tubular housing having the connector insertion-removal direction as a tube axial direction, and the latch hold body that is configured to connect a fixed end of the latch arm portion to an external wall surface of the tubular housing and make at least the first latch hold portion be opposingly arranged to a through-hole provided on the outer wall surface of the tubular housing, and the counterpart housing includes a counterpart tubular housing having the connector insertion-removal direction as a tube axial direction and configured to be inserted to and fitted in an internal space of the tubular housing, and the second latch hold portion projecting from an outer wall surface of the counterpart tubular housing.

13. The fitting connector according to claim 5, wherein the housing includes a tubular housing having the connector insertion-removal direction as a tube axial direction, and the latch hold body that is configured to connect a fixed end of the latch arm portion to an external wall surface of the tubular housing and make at least the first latch hold portion be opposingly arranged to a through-hole provided on the outer wall surface of the tubular housing, and the counterpart housing includes a counterpart tubular housing having the connector insertion-removal direction as a tube axial direction and configured to be inserted to and fitted in an internal space of the tubular housing, and the second latch hold portion projecting from an outer wall surface of the counterpart tubular housing.

14. The fitting connector according to claim 9, wherein the through-hole of the tubular housing is formed to be opposingly arranged to the first fulcrum portion also, and the holding structure uses an opposing wall surface to the first fulcrum portion via the through-hole in the outer wall surface of the counterpart housing as the first release-operation force receiving portion, and uses a peripheral edge portion of an opening on a connector insertion direction side in an opposing wall surface to the second fulcrum portion in the outer wall surface of the tubular housing as the second release-operation force receiving portion.

15. The fitting connector according to claim 1, wherein one of the first latch hold portion and the second latch hold portion is formed as a hole portion or a groove portion, and the other one is formed as a protrusion portion to insert to the hole portion or the groove portion.

16. The fitting connector according to claim 2, wherein one of the first latch hold portion and the second latch hold portion is formed as a hole portion or a groove portion, and the other one is formed as a protrusion portion to insert to the hole portion or the groove portion.

17. The fitting connector according to claim 3, wherein one of the first latch hold portion and the second latch hold portion is formed as a hole portion or a groove portion, and the other one is formed as a protrusion portion to insert to the hole portion or the groove portion.

18. The fitting connector according to claim 5, wherein one of the first latch hold portion and the second latch hold portion is formed as a hole portion or a groove portion, and the other one is formed as a protrusion portion to insert to the hole portion or the groove portion.

19. The fitting connector according to claim 9, wherein one of the first latch hold portion and the second latch hold portion is formed as a hole portion or a groove portion, and the other one is formed as a protrusion portion to insert to the hole portion or the groove portion.

20. The fitting connector according to claim 14, wherein one of the first latch hold portion and the second latch hold portion is formed as a hole portion or a groove portion, and the other one is formed as a protrusion portion to insert to the hole portion or the groove portion.

* * * * *